United States Patent [19]

Shimizu et al.

[11] Patent Number: 4,800,275

[45] Date of Patent: Jan. 24, 1989

[54] HEAT-DEVELOPING AND TRANSFERRING APPARATUS

[75] Inventors: Masayuki Shimizu; Sumio Yoshikawa, both of Kanagawa, Japan

[73] Assignee: Fuji Photo Film Co., Ltd., Kanagawa, Japan

[21] Appl. No.: 33,937

[22] Filed: Apr. 3, 1987

[30] Foreign Application Priority Data

| | | | |
|---|---|---|---|
| Apr. 3, 1986 | [JP] | Japan | 61-77457 |
| Apr. 18, 1986 | [JP] | Japan | 61-90372 |
| May 22, 1986 | [JP] | Japan | 61-118301 |
| May 22, 1986 | [JP] | Japan | 61-118298 |

[51] Int. Cl.[4] ..... G03C 5/08

[52] U.S. Cl. ..... 250/317.1; 250/318; 250/319; 355/27; 355/28

[58] Field of Search ..... 250/316.1, 317.1, 318, 250/319; 355/28, 3 TR, 3 DR, 27; 219/216

[56] References Cited

U.S. PATENT DOCUMENTS

| | | | |
|---|---|---|---|
| 4,620,096 | 10/1986 | Takehara et al. | 250/319 |
| 4,629,675 | 12/1986 | Takehara et al. | 430/203 |
| 4,660,964 | 4/1987 | Yoshikawa et al. | 355/28 |
| 4,665,303 | 5/1987 | Miyakawa et al. | 219/216 |
| 4,672,258 | 6/1987 | Konishi | 313/15 |
| 4,686,351 | 8/1987 | Nakauchi | 219/216 |
| 4,687,334 | 8/1987 | Miyakawa | 356/404 |
| 4,710,631 | 12/1987 | Aotsuka et al. | 250/354.1 |
| 4,716,285 | 12/1987 | Konishi | 250/205 |

FOREIGN PATENT DOCUMENTS

| | | | |
|---|---|---|---|
| 682261 | 3/1964 | Canada | 250/317.1 |

*Primary Examiner*—Carolyn E. Fields
*Assistant Examiner*—John A. Miller
*Attorney, Agent, or Firm*—Sughrue, Mion, Zinn, Macpeak and Seas

[57] ABSTRACT

A heat developing and transferring apparatus for conducting a heat development of a latent image formed on an exposed heat-developable photosensitive material and for conducting transfer of the developed image from said heat-developable photosensitive material to an image receiving material in the presence of an image forming solvent. The image receiving material and the heat-developable photosensitive material are superposed on a rotary drum in the mentioned order. An image formed on the heat-developable photosensitive material is transferred to the image receiving material by the heat generated by a heater. Then, the heat-developable photosensitive material is separated from the rotary drum and the image receiving material remaining on the rotary drum is dried before it is separated. Since the image receiving material carrying the transferred image is dried while it is on the rotary drum, there is no problem such as sticking or contamination even when the image receiving material with the image thereon is picked up by a hand.

20 Claims, 6 Drawing Sheets

HEAT-DEVELOPING AND TRANSFERRING APPARATUS

BACKGROUND OF THE INVENTION

The present invention relates to a heat-developing and transferring apparatus which performs a series of operations including application of an image forming solvent to a heat-developable photosensitive material or an image receiving material, developing the image by application of heat and transferring the developed image so as to form an image on the image receiving material.

An image recording apparatus which produces a color image by making use of a heat-developable photosensitive material is known. An example of such an image recording apparatus is disclosed in Japanese Patent Unexamined Publication No. 75247/1984. In this known apparatus, a color image is formed on an image receiving paper by a process which includes exposing a heat-developable photosensitive material to an image, conducting heat development for developing the image on the photosensitive material, superposing the photosensitive material after heat development on an image receiving material, and conducting transfer of image to the image receiving paper by application of heat.

In order to improve the transfer efficiency, a transfer assisting agent, i.e., an image forming solvent, such as water is applied to the image receiving paper before it is superposed on the heat-developable photosensitive material. After the transfer of the image by application of heat, the image receiving paper is peeled off the heat-developable photosensitive material. The image receiving material immediately after the separation from the photosensitive material has not been dried, i.e.,still wet. Such wet image receiving paper causes various problems such as sticking when stacked, contamination by finger patterns or other contaminants when picked up by fingers, and so forth. Such drawbacks are not mentioned at all in Japanese Unexamined Pat. No. 75247/1984.

SUMMARY OF THE INVENTION

Accordingly, an object of the present invention is to provide a heat-developing transfer apparatus having a compact construction and provided with a function for drying the image receiving material after separation from a heat-developable photosensitive material.

To this end, according to the present invention, there is provided a heat developing and transferring apparatus for conducting a heat development of a latent image formed on an exposed heat-developable photosensitive material and for conducting transfer of the developed image from the heat-developable photosensitive material to an image receiving material in the presence of an image forming solvent, comprising: a rotary drum on which the image receiving material and the heat-developable photosensitive material are adapted to be wound in layers; image receiving material supply means for supplying the image receiving material onto the rotary drum so as to wind the image receiving material on the outer peripheral surface of the rotary drum; conveyor means for conveying the heat-developable photosensitive material towards the rotary drum so as to wind the heat-developable photosensitive material on the image receiving material which has been wound on the rotary drum; application means for applying the image forming solvent to at least one of the image receiving material and the heat-developable photosensitive material; heating means for heating the heat-developable photosensitive material and the image receiving material on the rotary drum thereby effecting at least transfer of image; first separation means disposed in the vicinity of the outer peripheral surface of the rotary drum and adapted for separating the heat-developable photosensitive material after the heating from the image receiving material; drying means for drying the image receiving material remaining on the outer peripheral surface of the rotary drum after separation of the heat-developable photosensitive material; and second separation means disposed in the vicinity of the outer peripheral surface of the rotary drum and adapted for separating the dried image receiving material from the rotary drum.

According to this arrangement, the photosensitive material and the image receiving material superposed on each other are wound on the drum in close contact therewith and is heated by a suitable heating means, so that at least the transfer of image from the photosensitive material to the image receiving material is conducted on the drum. A safe transfer of the image is ensured by application of an image forming solvent to the photosensitive material or the image receiving material.

The image receiving material carrying the image transferred thereto is separated from the drum after drying on the drum, so that no problem is caused even when this material is pinched by fingers or otherwise handled by those who look into the recorded image.

The image forming solvent used in the present invention may be applied by an applicator of the type which is disclosed in the specification of Japanese Patent Application No. 168,411 filed by the same applicant. The applicator may be made of a water-absorbable material capable of holding water more or less, e.g., a sponge, a foamed porous material, a felt, a brush and so forth. The applicator also may be a roller type applicator of the type disclosed in Japanese Unexamined Patent Publication No. 158,547/1985 of the same applicant, a spray type applicator shown in the specification of Japanese Patent Application No. 158,547/1985 which sprays mist of the image forming solvent, or an applicator of the type disclosed in Japanese Unexamined Utility Model Publication No. 189,752 in which a solvent applicator is provided on a portion of an endless belt.

Heat-developable photosensitive materials (heat-developable photosensitive element) and image receiving materials (color fixing elements) shown in the following references are usable as the heat-developable photosensitive materials and image receiving materials in the present invention: the specifications of U.S. Pat. Nos. 4,430,415; 4,483,914; 4,500,626 and 4,503,137; Japanese Unexamined Patent Publication Nos. 154,445/1984; 165,054/1984; 180,548/1984; 218,444/1984; and 120,356/1985; and specifications of Japanese Patent Application Nos. 209,563/1984; 79,709/1985; 169,585/1985 and 244,873/1985.

The image forming agents used in the invention are solvents which are necessary for the formation of images, e.g., water or a low-boiling point organic solvent such as an alcohol, ketone and amide with or without the addition of an additive or additives such as a surfactant, development promoting agent, development stopping agent, and so forth.

The above and other objects, features and advantages of the present invention will become clear from the following description of the preferred embodiments when the same is read in conjunction with the accompanying drawings.

BRIEF DESCRIPTION OF THE PREFERRED EMBODIMENTS

DESCRIPTION OF THE PREFERRED EMBODIMENTS

Figure 1:
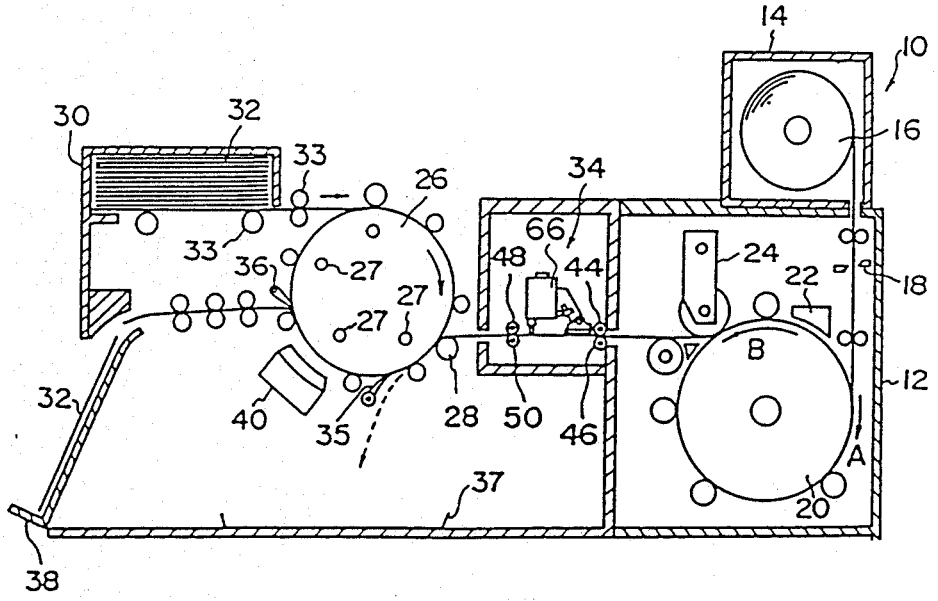
FIG. 1 is a sectional view of a first embodiment of the heat-developing and transferring apparatus in accordance with the present invention.

In FIG. 1, there is shown an image recording apparatus generally designated by a numeral 10 and incorporating a first embodiment of the heat-developing and transfer apparatus of the present invention.

The image recording apparatus 10 has a frame 12 which carries a magazine 14 accommodating a suitable length of sheet of a heat-developable photosensitive material 16. The photosensitive material 16 is extracted from the magazine 14 and is cut into a predetermined length by a cutter 18. The photosensitive material is then wound around an exposure drum 20 in the direction of an arrow A and is exposed through an exposure head 22. The drum 20 is then reversed as indicated by an arrow B and the photosensitive material is separated by a scraper 24. The separated photosensitive material is then sent to the outer peripheral portion of a rotary drum 26 through a water application section 34.

Image receiving paper sheets 32 are stacked in layers within a cassette 30 and are fed one-by-one to the rotary drum 26 by a conveyor roller 33. The image receiving paper sheet 32 reaches the rotary drum 26 earlier than the photosensitive material 16, so that it is placed on the inner side of the photosensitive material 16 when both are wound around the rotary drum 26. The rotary drum 26 incorporates a heater 27 so that the latent image on the photosensitive material 16 is developed by the heat from the heater 27. The heat also serves to transfer the developed image to the image receiving paper sheet 32. The heater 27 may be disposed externally of the rotary drum 26. The heater 27 may be disposed outside the rotary drum 26. Separator arms 35, 36 are disposed on the outer periphery of the rotary drum 26. The separator arm 35 acts to separate the photosensitive material 16 from the rotary drum 26 and sends the separated photosensitive material to a tray 37. The separator arm 36 acts to separate the image receiving paper sheet 32 from the rotary drum 26 and sends the separated image receiving paper sheet to a tray 38.

A drier 40 constituting drying means is disposed between the separation arms 35 and 36 so as to face the outer peripheral surface of the rotary drum 26. The arrangement is such that, after the photosensitive material 16 is separated, the drier 40 blows heated air to the image receiving paper sheet 32 on the rotary drum 20 so that the image receiving paper sheet 23 is dried while it is still on the rotary drum 26.

A detailed description will be made herein under as to the water application section 34, with specific reference to FIGS. 2 to 4.

The water application section 34 has a pair of conveyor rollers 44, 46 which are disposed in the vicinity of the exposure section and adapted for clamping therebetween the photosensitive material 16 conveyed thereto. Another pair of conveyor rollers 48, 50 are disposed downstream from the conveyor rollers 44, 46 so as to clamp and convey the photosensitive material 16. These rollers are driven by motors (not shown) so as to feed the photosensitive material 16 to a superposing roller 28. A guide plate 51 is disposed between the pairs of conveyor rollers so as to face the reverse side of the photosensitive material 16, i.e., non-image side of the photosensitive material 16.

Figure 4:
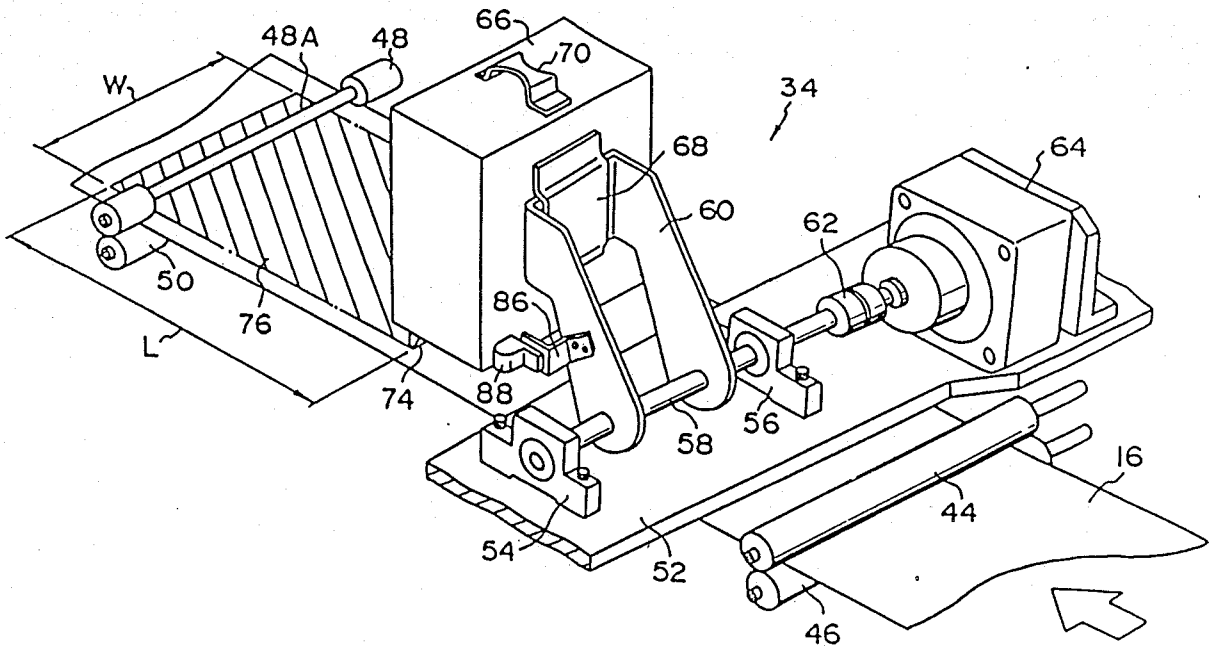
FIG. 4 is a perspective view of the water applicator in the position for applying water.

As will be seen also from FIG. 4, a bracket 52 is provided so as to extend above and in the vicinity of the image carrying surface of the image receiving paper sheet 32 at a position between the conveyor rollers 44 and 48. A rotary shaft 58 is rotatably carried by bearings 54 and 56 which are mounted on the bracket 52. A rotary arm 60 is fixed to the rotary shaft 58. The rotary arm 60 is composed of a plate-like material. Both ends of the rotary arm 60 are bent at a right angle so that the bent ends extend in parallel with each other. The extended ends of the rotary arm are fixed to the rotary shaft 58.

The end of the rotary shaft 58 projected from the bearing 56 is connected to a motor 64 through a coupling 62. The motor 64 is adapted to drive the rotary arm 60 between a position shown in FIG. 2 and a position shown in FIG. 3.

A clip 68 is fixed at its one end to a side wall of a tank 66, and fits on the central web portion of the rotary arm 60, thus securing the tank 66 to the rotary arm 60. The tank 66 is provided on the top thereof with a handle 70. The operator can easily demount the tank 66 by gripping and lifting the handle 70 because the clip 68 can easily slide out of engagement with the rotary arm 60. To facilitate the demounting of the tank 66, the clip 68 is preferably constituted by a leaf spring material.

Figure 2:
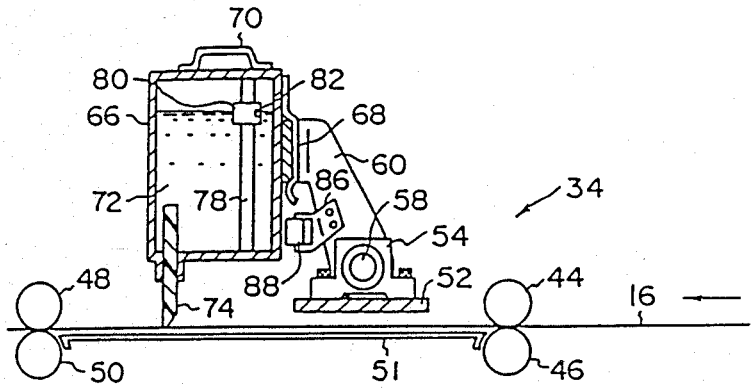
FIG. 2 is an enlarged view of a portion of the first embodiment shown in FIG. 1 illustrating the position where water is applied by a water applicator unit.

As will be seen from FIG. 2, the tank 66 is filled with water 72 as an image forming solvent. The water 72 is applied to the surface of the photosensitive material 16 through a porous felt 74. To this end, the felt has one end received in the tank 6 while the other end constituting an applicator portion is projected from the tank 66 so as to contact the photosensitive material 16. The application of water to an intermediate portion of the surface of the photosensitive material 16 is conducted when the rotary arm 60 and, hence, the tank 66 is in the position shown in FIGS. 2 and 4, whereas, in the state shown in FIG. 3, the felt 74 is kept away from the photosensitive material 16 so that water is not applied. This position of the tank 66 and the felt 74 will be referred to as "retracted position" hereinafter. As will be seen from FIG. 3, in the retracted position, the felt 74 is spaced from the water in the tank 66. By an accurate control of the rotation angle of the rotor of the motor 64 or by providing suitable stoppers, it is possible to stop the tank 66 exactly at the application position shown in FIG. 2 and at the retracted position shown in FIG. 3.

In FIG. 4, the hatched area is the portion of the photosensitive material which has been wetted by the water 76 applied by the felt 74. The width W of this wetted area 76 is adjustable by adjusting the width of the felt 74. The adjustment of the width W also is possible by using a mask covering the region which should not be wetted and allowing the felt 74 to contact with the photosensitive material 16 through this mask. As will be seen from FIG. 4, the upper downstream transfer roller 48 has an intermediate portion 48A of a reduced diameter so that the roller 48 contacts the photosensitive material only at both axial ends thereof. Thus, the photosensitive material 16 is pinched only at both widthwise ends thereof, thus eliminating any unfavorable effect on the wetted area. A guide rod 78 is mounted in the tank 66 such that it extends vertically when the tank 66 is i the application position shown in FIG. 2. A float 80 fits around the guide rod 78 so as to be able to move along the guide rod 78. The float 80 carries a magnet 82. Thus, the float 80 and the magnet 82 move along the guide rod 78 so as to follow any change in the water level within the tank 66.

A magnetic sensor 88 is secured to the rotary arm 60 through a bracket 86 for cooperation with the magnet 82 in the tank. When the tank 66 is in the application position shown in FIG. 2, the magnetic sensor 88 responds to the magnetism of the magnet 82 when the latter is moved to a predetermined height following up any change in the water level. Upon sensing the magnetism, the magnetic sensor produces a signal which activates a warning device thereby informing the operator that the amount of the water in the tank 66 has been decreased. The operator then supplies a required amount of water into the tank 66 or replaces the tank with a spare tank. Needless to say, the detection of the amount of water in the tank 66 may be conducted by various other types of sensor. It is also possible to construct the tank 66 from a transparent material so as to enable the water level to be visually checked from the outside.

Figure 3:
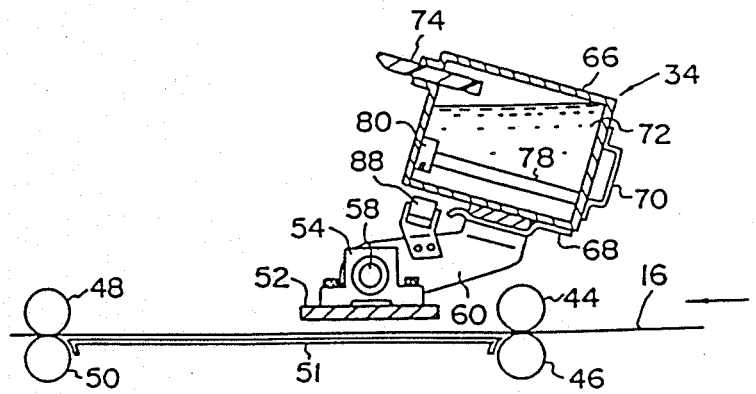
FIG. 3 is an illustration of the water applicator unit used in the first embodiment and set in a retracted position.

In the retracted position shown in FIG. 3, the tank 66 has been swung upward and clockwise and the felt 74 is positioned above and away from the water level without contacting the water in the tank 66, thus diminishing loss of the water due to evaporation through the felt 74.

The operation of the first embodiment will be described hereinunder.

An image receiving paper sheet 32 has been extracted from the cassette 30 by the conveyor roller 33 and wound on the outer peripheral surface of the rotary drum 26 in accordance with the rotation of the latter, with the image transfer side thereof directed outward. On the other hand, the heat-developable photosensitive material 16 fed from the magazine 14 is wound on the exposure drum 20 and its surface having an emulsion coating is exposed through the exposure head 22. The photosensitive material 16 is then fed to the water application section 34.

In the water application section 34, the motor 64 operates in synchronism with the conveyance of the photosensitive material 16 so as to bring the tank 66 to the application position as shown in FIG. 2. As the photosensitive material moved ahead, a required amount of water is applied to the surface of the photosensitive material 16. Thereafter, the motor 64 is reversed to lift up the tank 66 to the retracted position shown in FIG. 3.

With this arrangement, it is possible to control as desired the length L (see FIG. 4) of the wetted area along the length of the photosensitive material 16. In addition, the width W is determined by the width W of the wetted area 76. It is thus possible to apply the water only to the required region, i.e., the region corresponding to the image to be transferred, on the photosensitive material 16. As stated before, the wetted area 76 on the photosensitive material is bridged over by the reduced-diameter portion 48A of the conveyor roller 48 so that it is never affected adversely by the conveyor roller 48.

The photosensitive material 16 after the application of water in the water application section 34 is conveyed onto the rotary drum 26 and is superposed on the image transfer surface of the image receiving paper sheet 32 which has been already wound on the drum 26.

The image receiving paper sheet 32 and the photosensitive material 16 superposed thereon are heated by the heat from the heater 27, and heat development is conducted in the presence of the water. At the same time, the color image formed by the development is transferred by the heat to the emulsion layer surface of the image receiving paper sheet 32. In this state, photosensitive material 16 has been supplied with the required amount of water, so that the transfer is conducted in good order.

After the completion of the transfer, the rotary drum 26 starts to rotate again so that the photosensitive material 16 constituting the outer layer of two layers of sheets on the rotary drum 26 is separated by the operation of the separator arm 35 and is sent to a tray 37. Then, the dryer 40 starts to operate so that the image receiving paper sheet still remaining on the rotary drum 26 is dried and is then separated and sent to the tray 38 by the separator arm 38. Since the image receiving paper sheet has been dried, it exhibits no stickiness when pinched by fingers.

Although in the described embodiment the water is supplied to the photosensitive material 16 before the latter is fed to the rotary drum 26, this is not the only possible embodiment and the arrangement may be such that the water is applied to the image receiving paper sheet 32 before the latter is applied to the rotary drum 26.

Figure 5:
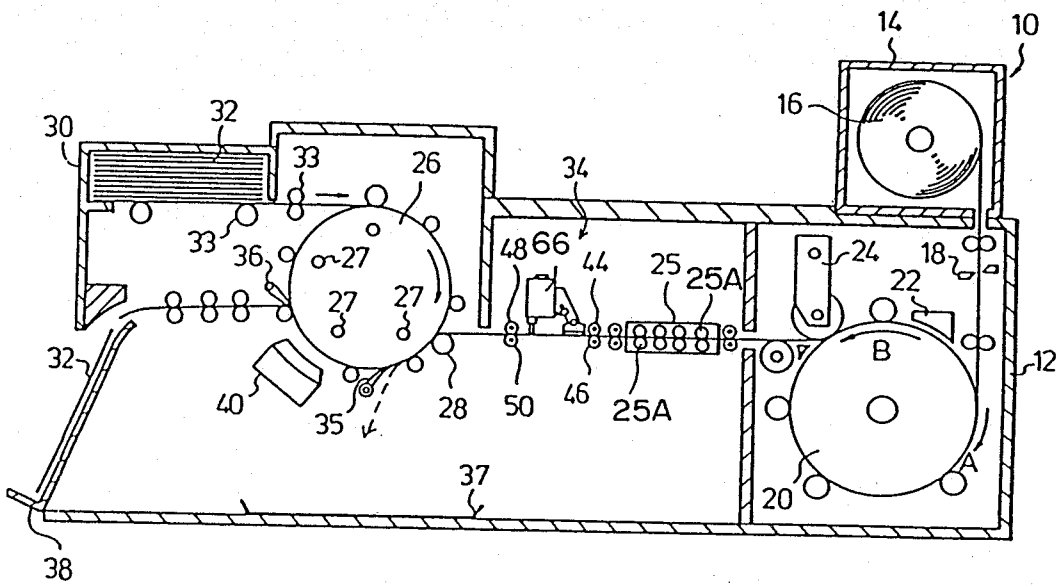
FIG. 5 is a sectional view of a second embodiment of the heat-developing transfer apparatus in accordance with the present invention.

A second embodiment of the invention will be described hereinunder with reference to FIG. 5. In this Figure, the same reference numerals are used to denote the same parts or members and the detailed description of such parts or members is omitted.

In this embodiment, the photosensitive material 16 wound on the outer peripheral surface of the exposure drum 20 is exposed by the exposure head 22 and is then separated from the exposure drum 20 through the exposure head 22. Then, the photosensitive material 16 is separated from the drum by a scraper 24 and is sent to a heat-developing device 25 where the latent image is developed by application of heat. Then, water is supplied to the photosensitive material 16 in a water application section 34.

More specifically, in this embodiment, the heat-developing device 25 has a plurality of pairs of heat rollers 25A which clamp the path line of the photosensitive material 16, so as to heat the photosensitive material 16 thereby developing the latent image in the emulsion layer surface of the photosensitive material 16.

The water application section 34 has a pair of conveyor rollers 44, 46 which are disposed in the vicinity of the exposure section and adapted for clamping the photosensitive material 16 after the development. Another pair of conveyor rollers 48,50 are disposed downstream from the first pair of conveyor rollers 44, 46 so as to clamp and convey the photosensitive material 16. These rollers are driven by motors so as to feed the photosensitive material 16 to the superposing roller 28.

A tank 66 is disposed so as to be able to supply the portion of the image transfer surface of the photosensitive material 16 between the conveyor rollers 44 and 48 with water as an image forming solvent, by means of an applicator such as a felt-type applicator. The construction and operation of the water application section 34 and the applicator means are substantially the same as those in the first embodiment, so that detailed description thereof is omitted.

Image receiving paper sheets 32 are stacked in layers within a cassette 30 and are fed one-by-one by to the rotary drum 26 by a conveyor roller 33. The image receiving paper sheet 32 reaches the rotary drum 26 earlier than the photosensitive material 16, so that it is placed on the inner side of the photosensitive material 16 when both are wound around the rotary drum 26. The image receiving paper sheet 32 is stably held on the surface of the rotary drum 26 by, for example, vacuum suction force. The rotary drum 26 incorporates a heater 27 so that the latent image on the photosensitive material 16 is developed by the heat from the heater 27. The heat also serves to transfer the developed image to the image receiving paper sheet 32. The heater 27 may be disposed outside the rotary drum 26. Separator arms 35, 36 are disposed on the outer periphery of the rotary drum 26. The separator arm 35 acts to separate the photosensitive material 16 from the rotary drum 26 and sends the separated photosensitive material to a tray 37. The separator arm 36 acts to separate the image receiving paper sheet 32 from the rotary drum 26 and sends the separated image receiving paper sheet to a tray 38.

A drier 40 constituting drying means is disposed between the separation arms 35 and 36 so as to face the outer peripheral surface of the rotary drum 26. The arrangement is such that, after the photosensitive drum 16 is separated, the drier 40 blows heated air to the image receiving paper sheet 32 on the rotary drum 20 so that the image receiving paper sheet 23 is dried while it is still on the rotary drum 26.

The operation of the second embodiment will be described hereinunder.

An image receiving paper sheet 32 has been extracted from the cassette 30 by the conveyor roller 33 and wound on the outer peripheral surface of the rotary drum 26 in accordance with the rotation of the latter, with the image transfer side thereof directed outward. On the other hand, the heat-developable photosensitive material 16 fed from the magazine 14 is wound on the exposure drum 20 and its surface having an emulsion coating is exposed through the exposure head 22. The photosensitive material 16 is then scraped off the exposure drum 20 by the scraper 24 and fed to the heat-developing section 25 where the latent image formed on the exposed surface of the photosensitive material 16 is developed by the heat derived from the heat rollers 25A. After the heat-development of the image, the photosensitive material is fed to the water application section 34.

In the water application section 34, operation is conducted in synchronism with the conveyance of the photosensitive material 16 so as to bring the tank 66 to the application position so that a required amount of water is supplied to the developed image on the photosensitive material.

The photosensitive material 16 after the application of water in the water application section 34 is conveyed onto the rotary drum 26 and is superposed on the image transfer surface of the image receiving paper sheet 32 which has been already wound on the drum 26.

The image receiving paper sheet 32 and the photosensitive material 16 superposed thereon are heated by the heat from the heater 27, so that the color image formed by the development is transferred by the heat to the emulsion layer surface of the image receiving paper sheet 32. In this state, photosensitive material 16 has been supplied with the required amount of water, so that the transfer is conducted in good order.

After the completion of the transfer, the rotary drum 26 starts to rotate again so that the photosensitive material 16 constituting the outer layer of two layers of sheets on the rotary drum 26 is separated by the operation of the separator arm 35 and is sent to a tray 37. Then, the dryer 40 starts to operate so that the image receiving paper sheet still remaining on the rotary drum 26 is dried and is then separated and sent to the tray 38 by the separator arm 36. Since the image receiving paper sheet has been dried, it exhibits no stickiness when pinched by fingers.

Although in the described embodiment the water is supplied to the photosensitive material 16 before the latter is fed to the rotary drum 26, this is not the only possible embodiment and the arrangement may be such that the water is applied to the image receiving paper sheet 32.

Figure 6:
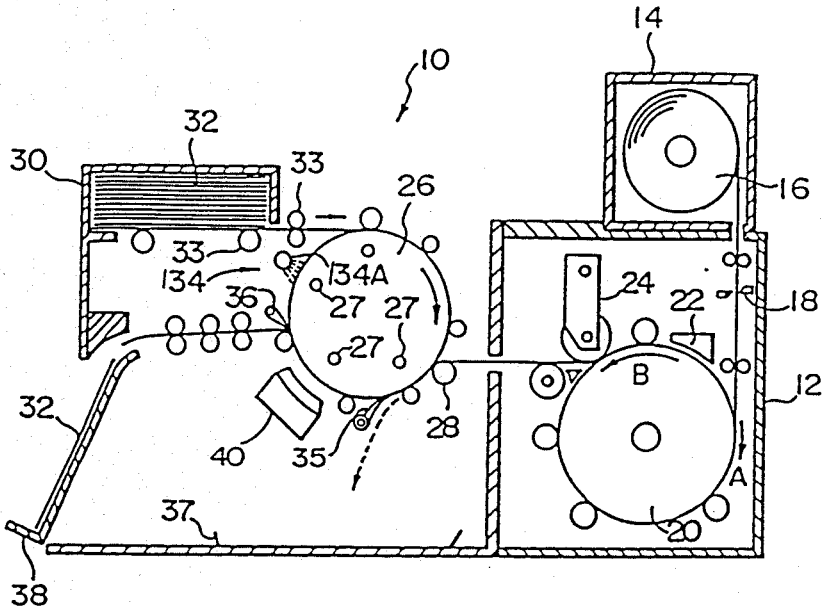
FIG. 6 is a sectional view of a third embodiment of the heat-developing transfer apparatus in accordance with the present invention.

A third embodiment of the present invention will be explained herein under with specific reference to FIG. 6. In this Figure, the same reference numerals are used to denote the same parts or members as those used in the firs embodiment, and detailed description thereof is omitted.

The third embodiment is characterized in that the water is applied to the image receiving paper sheet 32 when the latter is set on the rotary drum 26. The application of water is conducted by spraying.

More specifically, a water application unit 134 is disposed so as to face the outer peripheral surface of the rotary drum 26 and the water as the image forming solvent is applied to the outer peripheral image transfer surface of the image receiving material from a nozzle 134A of the water application unit 134. The application of water is conducted before the photosensitive material 16 is wound on the image receiving material 32 carried by the rotary drum 26. Other portions are materially the same as those in the first embodiment, so that detailed description thereof is omitted.

The operation of the third embodiment is as follows.

An image receiving paper sheet 32 has been extracted from the cassette 30 by the conveyor roller 33 and wound on the outer peripheral surface of the rotary drum 26 in accordance with the rotation of the latter, with the image transfer side thereof directed outward. Then, water is applied to the image transfer surface of the image receiving paper sheet 32 from the nozzle 134A of the water application unit 134. On the other hand, the heat-developable photosensitive material 16 fed from the magazine 14 is wound on the exposure drum 20 and is exposed through the exposure head 22. The photosensitive material 16 is then fed to rotary drum 26 and is superposed on the image receiving paper sheet 32 such that its exposed surface contacts the transfer surface of the image receiving paper sheet 32.

The image receiving paper sheet 32 and the photosensitive material 16 superposed thereon are heated by the heat from the heater 27, so that heat-development of the image is conducted in the presence of water and the color image formed by the development is transferred by the heat to the transfer surface of the image receiving paper sheet 32. In this state, photosensitive material 16 has been supplied with the required amount of water, so that the transfer is conducted in good order.

After the completion of the transfer, the rotary drum 26 starts to rotate again so that the photosensitive material 16 constituting the outer layer of two layers of sheets on the rotary drum 26 is separated and sent to a tray 37. Then, the dryer 40 starts to operate so that the image receiving paper sheet still remaining on the rotary drum 26 is dried and is then separated and sent to the tray 38 by the separator arm 36. Since the image receiving paper sheet has been dried, it exhibits no stickiness when pinched by fingers.

Although the application of water in the illustrated third embodiment is conducted by a spray of water from the nozzle, this is not exclusive and the water may be applied by any suitable applicator such as an applicator roller or a sponge.

In the described third embodiment, the water can be applied uniformly and the transfer of the image can be conducted with an extremely high degree of reliability because the water is applied to the image receiving material which is wound on the rotary drum.

Figure 7:
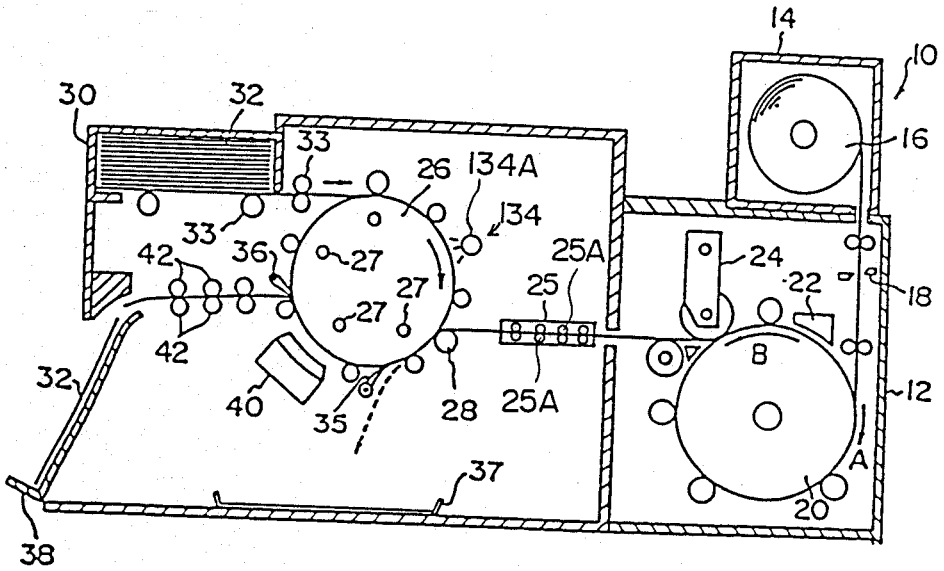
FIG. 7 is a sectional view of a fourth embodiment of the heat-developing transfer apparatus in accordance with the present invention.

A fourth embodiment of the invention will be described herein under with specific reference to FIG. 7. In this Figure, the same reference numerals are used to denote the same parts or members as those in the preceding embodiments and detailed description of such parts or members is omitted.

As in the case of the second embodiment, the fourth embodiment of the invention features a separate heat-developing device 25 arranged along the path of the exposed photosensitive material. In addition, the application of water is effected on the image receiving paper sheet 32 wound on the rotary drum, as in the case of the third embodiment.

More specifically, the fourth embodiments incorporates a developing device 25 having a plurality of pairs of heat rollers 25A arranged to define a path for the photosensitive material 16. The latent image carried by the photosensitive material 16 is developed as the photosensitive material 16 moved along the path defined by the nips of the pairs of heat rollers 25A.

The image receiving paper sheets 32 are stacked in a tray 30 mounted on the body 12 of the apparatus, and are adapted to be fed one-by-one from the lowermost one by the operation of the conveyor roller 33 onto the outer peripheral surface of the rotary drum 26 before the photosensitive material 16 is fed to the rotary drum 26 so as to closely contact with the outer peripheral surface of the rotary drum 26. Thus, the image receiving paper sheet constitutes the inner one of the two layers of sheet wound on the rotary drum 26.

A water application unit 134 is disposed to face the outer peripheral surface of the rotary drum 26. The water application unit 134 has a nozzle 134A constituting a water application means which sprays water as the image forming solvent onto the transfer surface of the image receiving material 32 wound on the outer peripheral surface of the rotary drum 26. The application of water is effected before the photosensitive material 16 is wound on the outer side of the image receiving paper sheet 32 on the rotary drum 26.

The operation of the fourth embodiment is as follows.

The image receiving paper sheet is fed from the cassette 30 onto the rotary drum 26 by the operation of the conveyor roller 30 and is wound on the rotary drum 26 such that the image transfer surface thereof is directed outward. Then, the water as the image forming solvent is applied to the image transfer surface of the image receiving paper sheet 32 from the nozzle 52. On the other hand, the photosensitive material 16, which has been extracted from the magazine 14 and cut by the cutter 18, is wound on the exposure drum 20 and is exposed through the exposure head 22. The thus exposed photosensitive material 16 is separated from the exposure drum 20 by the scraper 24 and is sent to the heat-developing device 25 where the latent image formed on the photosensitive material 16 is developed by the heat derived from the heat rollers 25A. After the development, the photosensitive material 16 is wound on the image receiving paper sheet 32 which has ben already wound on the rotary drum 26, such that the inner surface of the photosensitive material 16 carrying the developed image closely contacts the image transfer surface of the image receiving material 32.

Then, the heater 27 is supplied with electric power so as to generate heat which heats both the photosensitive material 16 and the image receiving paper sheet 32 on the rotary drum 26, so that the developed image carried by the photosensitive material 16 is transferred to the image receiving paper sheet 32. This transfer of image can be conducted with a high degree of reliability because the photosensitive material 16 and the image receiving material 32 closely contact each other over their entire surfaces.

After the completion of transfer of the image, the rotary drum 26 further rotates to enable the scraper 35 to separate the photosensitive material 16 from the outer surface of the image receiving paper sheet 32 and to send the separated photosensitive material to the tray 37. Then, the dryer 40 operates to dry the image receiving paper sheet 32 remaining on the rotary drum 26. Then, the scraper 36 separates the dried paper sheet from one end of the latter and the separated sheet is conveyed by conveyor rollers 42 which effectively straighten the sheet to eliminate any curling tendency of the sheet. The image receiving paper sheet carrying the transferred image is finally delivered at the tray 38. Since the delivered image receiving paper sheet has been already dried, the operator can pick up and hold the sheet for the purpose of visual check of the image, without any risk of sticking or contamination.

What is claimed is:

1. A heat developing and transferring apparatus for conducting a heat development of a latent image formed on an exposed heat-developable photosensitive material and for conducting transfer of the developed image from said heat-developable photosensitive material to an image receiving material in the presence of an image forming solvent, comprising:

a rotary drum on which said image receiving material and said heat-developable photosensitive material are wound in layers;

image receiving material supply means for supplying said image receiving material onto said rotary drum so as to wind said image receiving material on an outer peripheral surface of said rotary drum;

conveyor means for conveying said heat-developable photosensitive material towards said rotary drum so as to wind said heat-developable photosensitive material on said image receiving material which has been wound on said rotary drum;

application means for applying said image forming solvent to only one side of at least one of said image receiving material and said heat-developable photosensitive material;

first heating means for heating said heat-developable photosensitive material and said image receiving material on said rotary drum so as to effect at least transfer of the image;

first separation means disposed in the vicinity of the outer peripheral surface of said rotary drum for separating said heat-developable photosensitive material after the heating from said image receiving material;

drying means for drying said image receiving material remaining on the outer peripheral surface of said rotary drum after separation of said heat-developable photosensitive material; and second separation means disposed in the vicinity of the outer peripheral surface of said rotary drum for separating the dried image receiving material from said rotary drum.

2. A heat developing and transferring apparatus according to claim 1, wherein said first heating means effects heat development of the latent image on said heat-developable photosensitive material in addition to the transfer of the developed image.

3. A heat developing and transferring apparatus according to claim 1, wherein said first heating means includes a heater disposed in said rotary drum.

4. A heat developing and transferring apparatus according to claim 1, wherein said application means is disposed in the vicinity of the outer periphery of said rotary drum for applying said image forming solvent to said image receiving material held on the outer periphery of said rotary drum.

5. A heat developing and transferring apparatus according to claim 1, wherein said application means is arranged so as to apply said image forming solvent to said heat-developable photosensitive material which is being conveyed towards said rotary drum.

6. A heat developing and transferring apparatus according to claim 1, further comprising second heating means for heating said heat-developable photosensitive material which is being conveyed towards said rotary drum, so as to effect heat development of image on said heat-developable photosensitive material.

7. A heat developing and transferring apparatus according to claim 6, wherein said first heating means effects only the transfer of the image by heat.

8. A heat developing and transferring apparatus according to claim 7, wherein said application means is disposed downstream from said second heating means as viewed in the direction of movement of said heat-developable photosensitive material so as to be able to apply said image forming solvent to said heat-developable photosensitive material after the heat-development effected by said second heating means.

9. A heat developing and transferring apparatus according to claim 7, wherein said application means is disposed in the vicinity of the outer periphery of said rotary drum for applying said image forming solvent to said image receiving material held on the outer periphery of said rotary drum.

10. A heat developing and transferring apparatus for conducting a heat development of a latent image formed on an exposed heat-developable photosensitive material and for conducting transfer of the developed image from said heat-developable photosensitive material to an image receiving material in the presence of an image forming solvent, comprising:

a rotary drum for holding said image receiving material and said heat-developable photosensitive material wound thereon;

image receiving material supply means for supplying said image receiving material onto said rotary drum so as to wind said image receiving material on an outer peripheral surface of said rotary drum;

photosensitive material conveyor means for conveying said heat-developable photosensitive material towards said rotary drum so as to wind said heat-developable photosensitive material on said image receiving material which has been wound on said rotary drum;

application means for applying said image forming solvent to only one side of at least one of said image receiving material and said heat-developable photosensitive material;

heating means for heating said heat-developable photosensitive material and said image receiving material on said rotary drum so as to effect heat-development of the image on said heat-developable photosensitive material and transfer of the developed image from said heat-developable material to said image receiving material;

first separation means disposed in the vicinity of the outer peripheral surface of said rotary drum for separating said heat-developable photosensitive material after the heating form said image receiving material;

drying means for drying said image receiving material remaining on the outer peripheral surface of said rotary drum after separation of said heat-developable photosensitive material; and second separation means disposed in the vicinity of the outer peripheral surface of said rotary drum for separating the dried image receiving material from said rotary drum.

11. A heat developing and transferring apparatus according to claim 10, wherein said heating means includes a heater disposed in said rotary drum.

12. A heat developing and transferring apparatus according to claim 10, wherein said application means is disposed in the vicinity of the outer periphery of said rotary drum for applying said image forming solvent to said image receiving material held on the outer periphery of said rotary drum.

13. A heat developing and transferring apparatus according to claim 10, wherein said application means includes means for spraying said image forming solvent.

14. A heat developing and transferring apparatus according to claim 11, wherein said application means is arranged so as to apply said image forming solvent to said heat-developable photosensitive material which is being conveyed towards said rotary drum.

15. A heat developing and transferring apparatus according to claim 10, wherein said drying means includes a dryer for blowing heated air onto said image receiving material.

16. A heat developing and transferring apparatus for conducting a heat development of a latent image formed on an exposed heat-developable photosensitive material and for conducting transfer of the developed from said heat-developable photosensitive material to an image receiving material in the presence of an image forming solvent, comprising:

a rotary drum for holding said image receiving material and said heat-developable photosensitive material wound thereon:

image receiving material supply means for supplying said image receiving material onto said rotary drum so as to wind said image receiving material on an outer peripheral surface of said rotary drum;

photosensitive material conveyor means for conveying said heat-developable photosensitive material towards said rotary drum so as to wind said heat-developable photosensitive material on said image receiving material which has been wound on said rotary drum;

application means for applying said image forming solvent to only one side of at least one of said image receiving material and said heat-developable photosensitive material;

first heating means for heating said heat-developable photosensitive material which is being conveyed, so as to effect heat development of the image on said heat-developable photosensitive material;

second heating means for heating said heat-developable photosensitive material and said image receiving material on said rotary drum so as to effect heating transfer of the developed image from said heat-developable material to said image receiving material;

first separation means disposed in the vicinity of the outer peripheral surface of said rotary drum for separating said heat-developable photosensitive material after the heating by said second heating means from said image receiving material;

drying means of drying said image receiving material remaining on the outer peripheral surface of said rotary drum after separation of said heat-developable photosensitive material; and second separation means disposed in the vicinity of the outer peripheral surface of said rotary drum for separating the dried image receiving material from said rotary drum.

17. A heat developing and transferring apparatus according to claim 16, wherein said application means is disposed downstream from said first heating means along the path of convey of said heat-developable photosensitive material so as to apply said image forming solvent to said heat-developable photosensitive material.

18. A heat developing and transferring apparatus according to claim 16, wherein said application means is disposed in the vicinity of the outer periphery of said rotary drum so as to apply an image forming solvent to said image receiving material.

19. A heat developing and transferring apparatus according to claim 17, wherein said second heating means includes a heater disposed in said rotary drum.

20. A heat developing and transferring apparatus according to claim 18, wherein said second heating means includes a heater disposed in said rotary drum.

* * * * *